US006148474A

United States Patent [19]

Ohara et al.

[11] Patent Number: 6,148,474

[45] Date of Patent: Nov. 21, 2000

[54] VACUUM CLEANER AND WAND ASSEMBLY

[75] Inventors: Naoyuki Ohara, Shiga, Japan; William R. Tracy, Stanford, Ky.

[73] Assignee: Matsushita Electric Corporation of America, Danville, Ky.

[21] Appl. No.: 09/294,426

[22] Filed: Apr. 19, 1999

Related U.S. Application Data

[60] Provisional application No. 60/082,659, Apr. 22, 1998.

[51] Int. Cl.[7] ..... A47L 5/36; A47L 9/28

[52] U.S. Cl. ..... 15/377; 15/410; 285/7

[58] Field of Search ..... 15/377, 410; 285/7; 174/47

[56] References Cited

U.S. PATENT DOCUMENTS

| | | | |
|---|---|---|---|
| 2,196,459 | 4/1940 | Forsberg | 285/7 |
| 3,244,437 | 4/1966 | Belicka et al. | 285/7 |
| 3,534,317 | 10/1970 | Descarries et al. | 285/7 |
| 3,961,647 | 6/1976 | Doubleday | 138/103 |
| 4,079,965 | 3/1978 | Moughty et al. | 285/7 |
| 4,319,380 | 3/1982 | Simm et al. | 15/410 |
| 4,494,270 | 1/1985 | Ritzau et al. | 15/377 |
| 4,989,295 | 2/1991 | Guhne et al. | 15/410 |
| 5,031,266 | 7/1991 | Tillman et al. | 15/327.2 |
| 5,046,761 | 9/1991 | Cordes | 285/7 |
| 5,113,547 | 5/1992 | Mayhew | 15/322 |
| 5,332,266 | 7/1994 | Canale | 285/7 |
| 5,484,974 | 1/1996 | Vellmer et al. | 219/85.22 |
| 5,568,943 | 10/1996 | Kilström et al. | 285/7 |
| 5,692,782 | 12/1997 | Fischer | 285/7 |
| 5,740,583 | 4/1998 | Shimada et al. | 15/377 |
| 5,855,036 | 1/1999 | Krock | 15/339 |
| 5,941,575 | 8/1999 | Herbst | 285/7 |

*Primary Examiner*—Robert J. Warden, Sr.
*Assistant Examiner*—Theresa T. Snider
*Attorney, Agent, or Firm*—King and Schickli, PLLC

[57] ABSTRACT

An electric vacuum cleaner includes a canister housing having an internal chamber and a suction inlet and an exhaust outlet both communicating with that chamber. The vacuum cleaner also includes a suction generator and dust collector both held in the internal chamber. Further, the vacuum cleaner includes a nozzle for picking up dirt and debris and a motor driven agitator and drive motor carried on that nozzle. Finally, a hose and wand assembly are provided. The wand assembly provides fluid communication between the outlet of the nozzle and the hose leading to the suction inlet of the canister housing. The wand assembly includes respective first and second telescoping tubes constructed from metal, an electrical conductor and a telescoping insulator assembly including a channel for receiving and holding the electrical conductor in substantially any respective position of the first and second telescoping tubes.

37 Claims, 9 Drawing Sheets

VACUUM CLEANER AND WAND ASSEMBLY

This application claims the benefit of U.S. provisional application Ser. No. 60/082,659, filed Apr. 22, 1998.

TECHNICAL FIELD

The present invention relates generally to the field of vacuum cleaners and extractors and, more particularly, to a unique telescoping wand that includes an electrical conductor for providing power to an agitator drive motor mounted in the pick up or floor nozzle.

BACKGROUND OF THE INVENTION

It is well known in the art to provide a vacuum cleaner that comprises a nozzle assembly for picking up dirt and debris from a surface to be cleaned such as a carpeted or hardwood floor and a canister body that has a dust bag for collecting dirt and debris and a suction motor and fan assembly for generating the necessary negative pressure to draw the dirt and debris into the dust bag for collection. The canister body is, of course, supported on wheels so that it may be easily moved from room to room during cleaning.

A wand and flexible hose provide fluid communication between the nozzle assembly and the dust bag and suction motor and fan assembly housed in the canister body. The provision of a telescoping wand assembly is desired so that the length of the wand may be adjusted for carefree and convenient manipulation by an operator of substantially any height. Such telescoping wand assemblies are well known in the art, examples of which being disclosed in U.S. Pat. Nos. 5,568,943 to Kilstrom et al., 5,332,266 to Canale and 5,046,761 to Cordes.

In order to provide the best cleaning performance, it is generally necessary to provide a motor in the nozzle assembly for powering or driving a rotating agitator or brush. Specifically, the rotating agitator/brush beats dirt and debris from the nap of the carpet so that it may be drawn through the nozzle assembly, wand and hose into the dust bag by operation of the negative pressure created by the suction motor and fan assembly.

The agitator/brush motor in the nozzle assembly receives its power through an electrical conductor that extends from the canister body through or along the hose and wand to the nozzle assembly. This conductor by necessity must be sufficiently long to extend the full length of the telescoping wand when in the fully extended position. When in a retracted position, the wand must be able to accommodate the slack in this conductor.

To date, the design of telescoping wands do not efficiently and effectively address this problem. Many prior art telescoping wands include heavy plastic tubes that require a thick sidewall for strength which necessarily reduces the diameter of the lumen provided for the passage of dirt and debris to the canister body. Further, many prior art designs include connecting structures and/or conductor receiving sleeves or passageways which project into and further close this lumen. This not only reduces cleaning efficiency, but in many cases also provides comers and structures for catching and entangling debris and thereby causing a tendency to clog the lumen further reducing cleaning power.

In addition, prior art telescoping wands do not generally provide the desired level of protection to the electrical power conductor as the wand is retracted and extended continuously over its surface life. As such, conductor failure is not uncommon and a need is identified for improvements in overall telescoping wand design.

SUMMARY OF THE INVENTION

It is a primary object of the present invention to provide a telescoping wand that provides a larger, unobstructed flow pathway for the passage of air and entrained dirt and debris from the nozzle to the dirt collection means or dust bag.

Another object of the present invention is to provide a telescoping wand with an electrical conductor for providing power to an agitator drive motor located on the nozzle wherein the wand tubes are constructed from metal. Advantageously, metal requires a thinner cross-section of material than plastic to provide the required strength. Accordingly, the use of metal materials in the construction of the tubes allows for both (a) a larger lumen to function as a flow pathway for air and dirt to provide increased cleaning performance and (b) a smaller overall outer diameter wand that is easier to hold and manipulate.

Yet another object of the present invention is to provide a telescoping wand including a sheath and outer housing on a first tube of the wand and a conductor casing on a second tube of the wand so that the electrical conductor is captured and fully insulated from the tubes in all telescoping positions. Yet another object of the present invention is to provide a novel telescoping wand wherein the insulating sheath and outer housing on the first tube and the conductor casing on the second tube are mounted to couplings carried on the ends of the tubes. Since there is no direct mounting of these components to the tubes, the interior walls of the tubes are smooth, continuous and unobstructed. Accordingly, turbulence and the presence of low pressure zones in the air flow pathway are substantially eliminated to allow maximum cleaning performance and efficiency.

Still another object of the present invention is to provide a vacuum cleaner or extractor incorporating the unique telescoping wand.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, a wand assembly is provided. The wand assembly provides fluid communication between the outlet of a nozzle and the hose leading to the suction inlet of a canister housing of a vacuum cleaner or an extractor. Such a vacuum cleaner or extractor includes a nozzle equipped with an agitator and an agitator drive motor.

The wand assembly includes respective first and second telescoping tubes formed from metal. Preferably aluminum or steel is used to form the tubes although other appropriate metals may be utilized. The wand assembly also includes an electrical conductor that carries electricity from the hose and canister housing to the agitator drive motor carried by the nozzle. In addition, the wand assembly includes an insulator assembly providing a channel for receiving and holding the electrical conductor in substantially any respective position of the first and second telescoping tubes. Thus, the insulator assembly effectively electrically insulates the electrical conductor from the first and second telescoping tubes in substantially any assumable telescoping position of the first and second telescoping tubes.

A hose coupling is secured to the first end of the first telescoping tube. A wand coupling is secured to a second end of the first telescoping tube. An anchor sleeve is secured to a first terminus of the second telescoping tube. A nozzle coupling is secured to a second terminus of the second telescoping tube.

Preferably, the insulator assembly includes an electrically insulating sheath that extends along substantially the full length of the first telescoping tube between the hose coupling and the wand coupling. Further, the insulator assembly includes an electrically insulating conductor casing that extends along substantially the full length of the second telescoping tube between the nozzle coupling and the anchor sleeve. The conductor casing comprises first and second strip members that are connected together to define a channel for receiving a portion of the electrical conductor. Still further, the insulator assembly includes an outer housing that engages the sheath so as to define a second channel for telescopingly receiving the conductor casing and the electrical conductor when the wand is in a fully retracted position. The outer housing is connected directly to the sheath by means of cooperating interlocking tabs and notches. Neither the sheath nor the outer housing are directly connected to the first telescoping tube and, accordingly, a smooth substantially uninterrupted sidewall is provided along substantially the entire length of that tube for efficient air flow. Similarly, neither of the strip members are directly secured to the second telescoping tube and accordingly it too has a smooth substantially uninterrupted sidewall along its entire length for efficient air flow.

In accordance with still another aspect of the present invention, the electrical conductor includes an extension in the form of a ribbon cable, a first terminal that engages the ribbon cable and a second terminal that engages the nozzle coupling. Additionally, a removable fuse module is provided. The removable fuse module is secured to the hose coupling and engages the ribbon cable. In this position, the fuse module may be easily accessed to replace the fuse provided in line with the electrical conductor and the agitator drive motor.

In accordance with still additional aspects of the present invention, the wand coupling is secured to the first telescoping tube and includes an actuator and cooperating locking pin. The second telescoping tube includes a series of locking notches longitudinally spaced along the tube for selectively receiving the locking pin so as to secure and lock the first and second telescoping tubes in a selected telescoping position. A spring biases the actuator and the cooperating locking pin into the locked position.

Still further, a guide pin is carried on the wand coupling and a registration groove extends longitudinally along the second telescoping tube. The guide pin engages in this registration groove to prevent relative rotation between the first and second telescoping tubes in all selected positions. Snap clip receiving apertures are provided in the wand coupling and the first telescoping tube. A snap clip is utilized to engage in these apertures to secure the wand coupling and first telescoping tube together.

In accordance with yet another aspect of the present invention an electric vacuum cleaner is provided. The electric vacuum cleaner comprises a hose and a canister housing including an internal chamber. The canister housing also includes a suction inlet and an exhaust outlet both communicating with the chamber. A suction generator and dust collector are both held in the internal chamber. A dust collector is provided between the inlet and the suction generator. The vacuum cleaner also includes a nozzle for picking up dirt and debris. The nozzle includes both an inlet and an outlet. A motor driven agitator and drive motor are carried on the nozzle. In addition, the vacuum cleaner incorporates the unique and novel wand assembly described throughout this document.

In accordance with still another aspect of the present invention, an extractor is provided. The extractor includes a housing having an internal dirt collection chamber. The housing also carries a suction generator. A nozzle is provided for picking up dirt and debris. The nozzle includes an inlet and an outlet. A motor driven agitator and drive motor are also carried on the nozzle. Additionally, the extractor incorporates the unique and novel wand assembly described throughout this document.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of the specification, illustrates several aspects of the present invention and together with the description serves to explain the principles of the invention. In the drawing.

Reference will now be made in detail to the present preferred embodiment of the invention, an example of which is illustrated in the accompanying drawing.

DETAILED DESCRIPTION OF THE INVENTION

Figure 1:
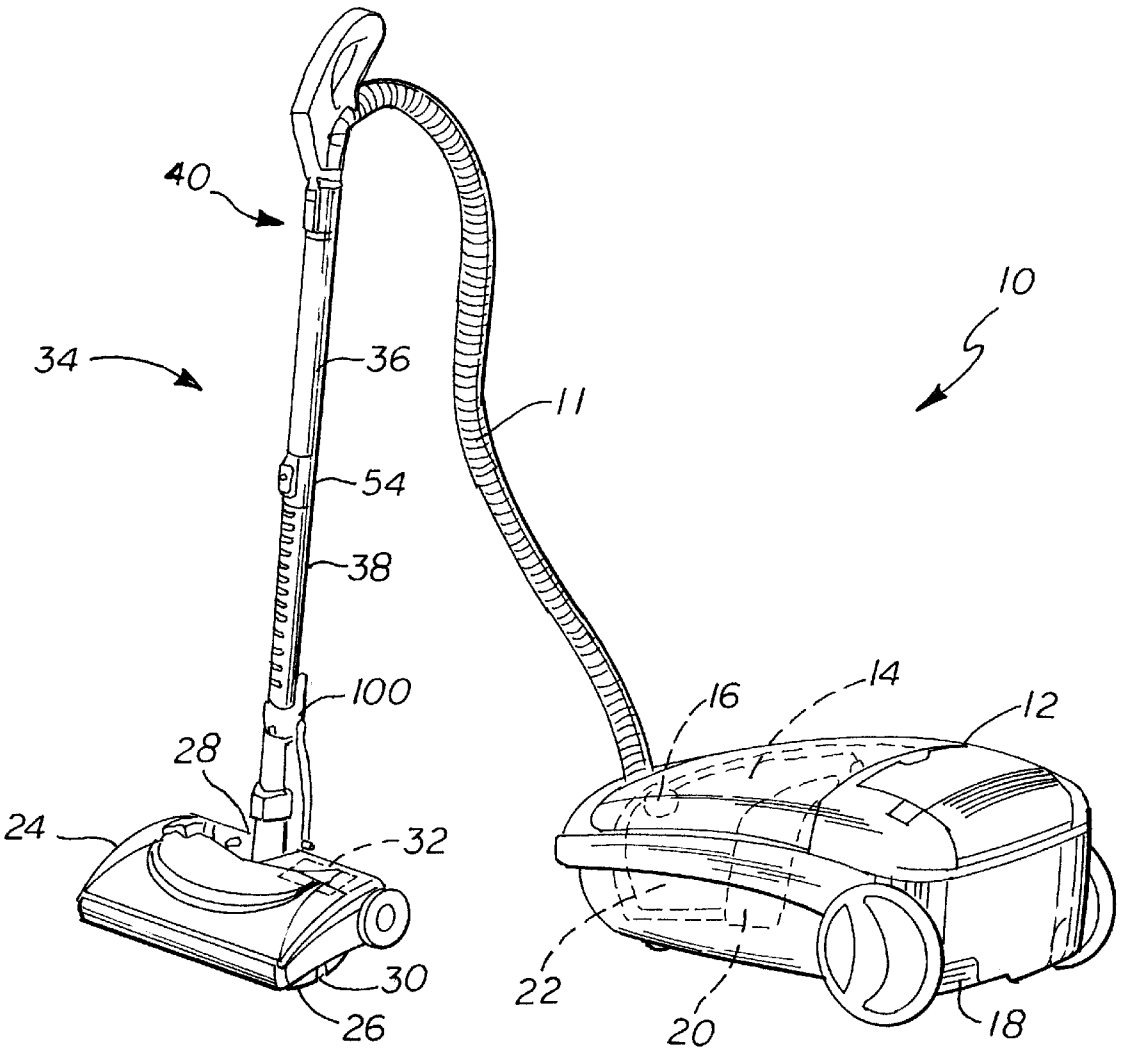
FIG. 1 is a perspective view showing an electric vacuum cleaner incorporating the wand assembly of the present invention.

Reference is now made to FIG. 1 showing a vacuum cleaner 10 including a hose 11 and a canister housing 12. Canister housing 12 includes an internal chamber 14 as well as a suction inlet 16 and an exhaust outlet 18 both communicating with that chamber. A suction generator, in the form of a fan and motor assembly generally designated by reference numeral 20 is held in the chamber 14. Additionally, a dust collector in the form of a dust bag 22 is held in the internal chamber 14 between the suction inlet 16 and the suction generator 20.

Figure 2A:
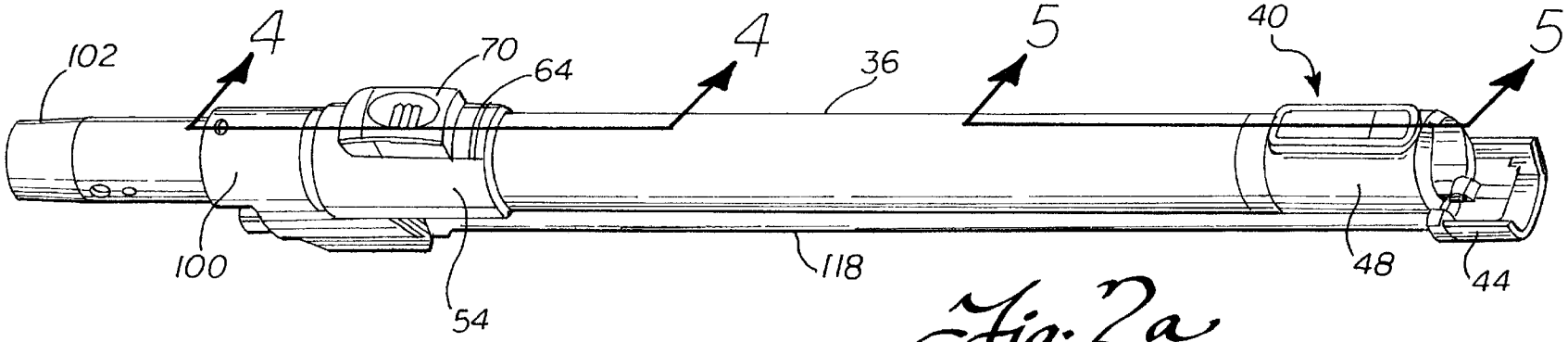
FIG. 2*a* is a perspective view of the wand assembly in the fully retracted position.

The vacuum cleaner 10 also includes a nozzle 24 for picking up dirt and debris. The nozzle 24 includes an inlet 26 and an outlet 28. The nozzle houses a motor driven agitator 30 and a drive motor 32 for driving the agitator. A telescoping wand assembly generally designated by reference numeral 34 operatively connects the nozzle 24 to the hose 11 that is connected to the suction inlet 16 of the canister housing 12. As best shown in FIGS. 2*a,* 2*b,* 3*a,* 3*b* and 10, the telescoping wand assembly 34 includes a first or outer tube 36 and a cooperating second or inner tube 38. Both tubes 36, 38 are constructed from metal. Preferably, aluminum or steel is utilized although other metal materials could be used. Advantageously, metal provides greater strength than plastic and, accordingly, each of the tubes 36, 38 may be constructed with a relatively thinner cross-section. As a result, each of the tubes 36, 38 may be provided with a lumen or air pathway of increased cross-sectional area to provide greater cleaning power while at the same time, the outer diameter of the tubes may be reduced to allow easier grasping and more confident manipulation by the user. Thus, two very significant advantages are provided.

Figure 4:
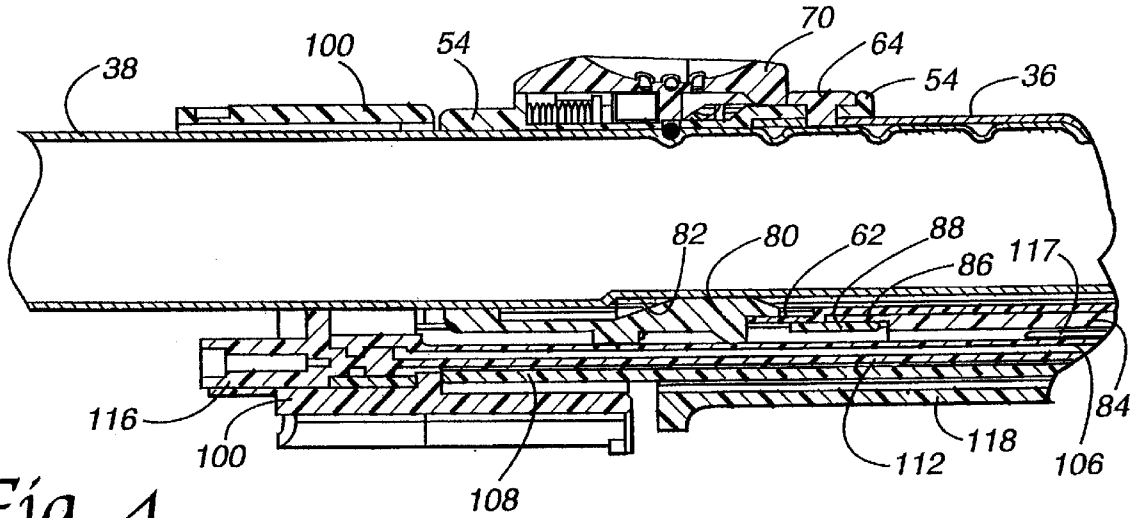
FIG. 4 is a cross-sectional view taken along line 4—4 of FIG. 2*a;*
Figure 5:
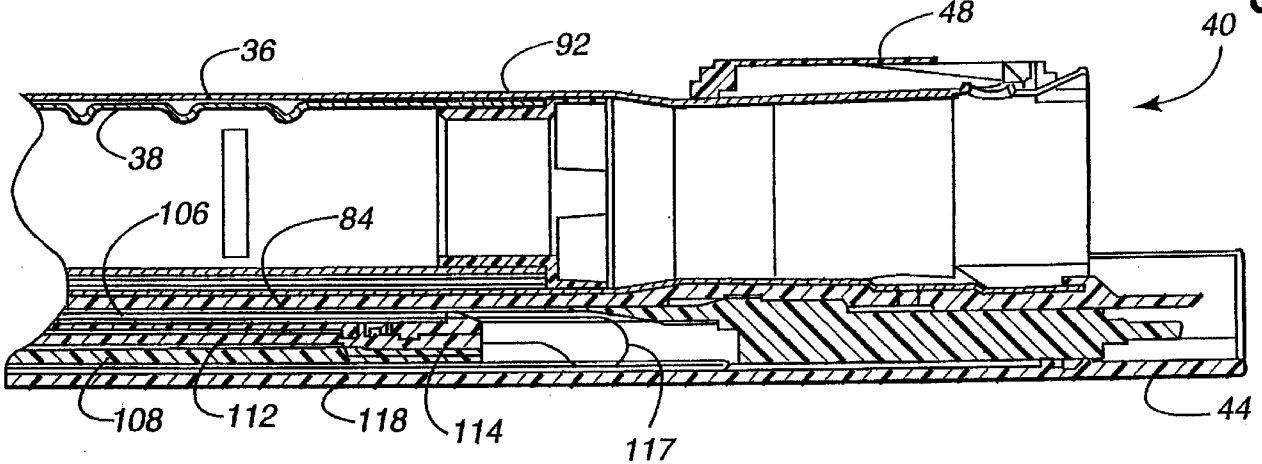
FIG. 5 is a cross-sectional view taken along line 5—5 of FIG. 2*a;*
Figure 8:
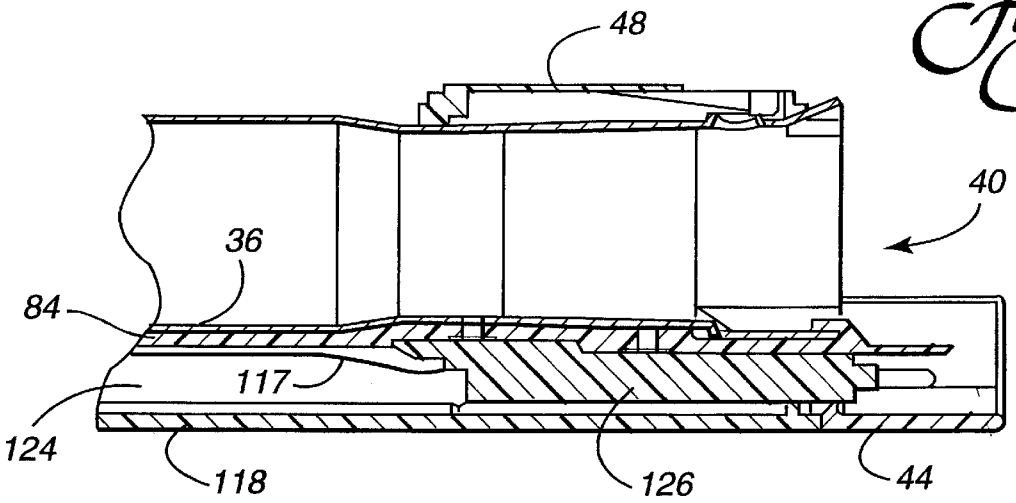
FIG. 8 is a cross-sectional view taken along line 8—8 of FIG. 3*a;*

A hose coupling 40 is secured to a first end 42 of the first tube 36 (see also FIGS. 5 and 8). Hose coupling 40 includes a first portion 44 that may be secured to the first tube 36 by means of a pair of rivets 46 and a second portion 48 that snaps to the first portion 44 by means of cooperating tabs 50 and openings 52. Together the first and second portions 44, 48 are concentrically received about the full circumstance of the first end 42 of the first tube 36. A wand coupling 54 is secured to the second end 56 of the first tube 36 (see also FIGS. 4, 7, 9, 9*a* and 9*b*). Specifically, the wand coupling 54 includes a projecting lug 58 having a shoulder 60 that engages a notched section 62 of the first tube 36. Additionally, a snap clip 64 includes prongs 66 that engage in cooperating aligned apertures 67 in the wand coupling 54 and outer tube 36 to secure the wand coupling 54 in position.

Figure 7:
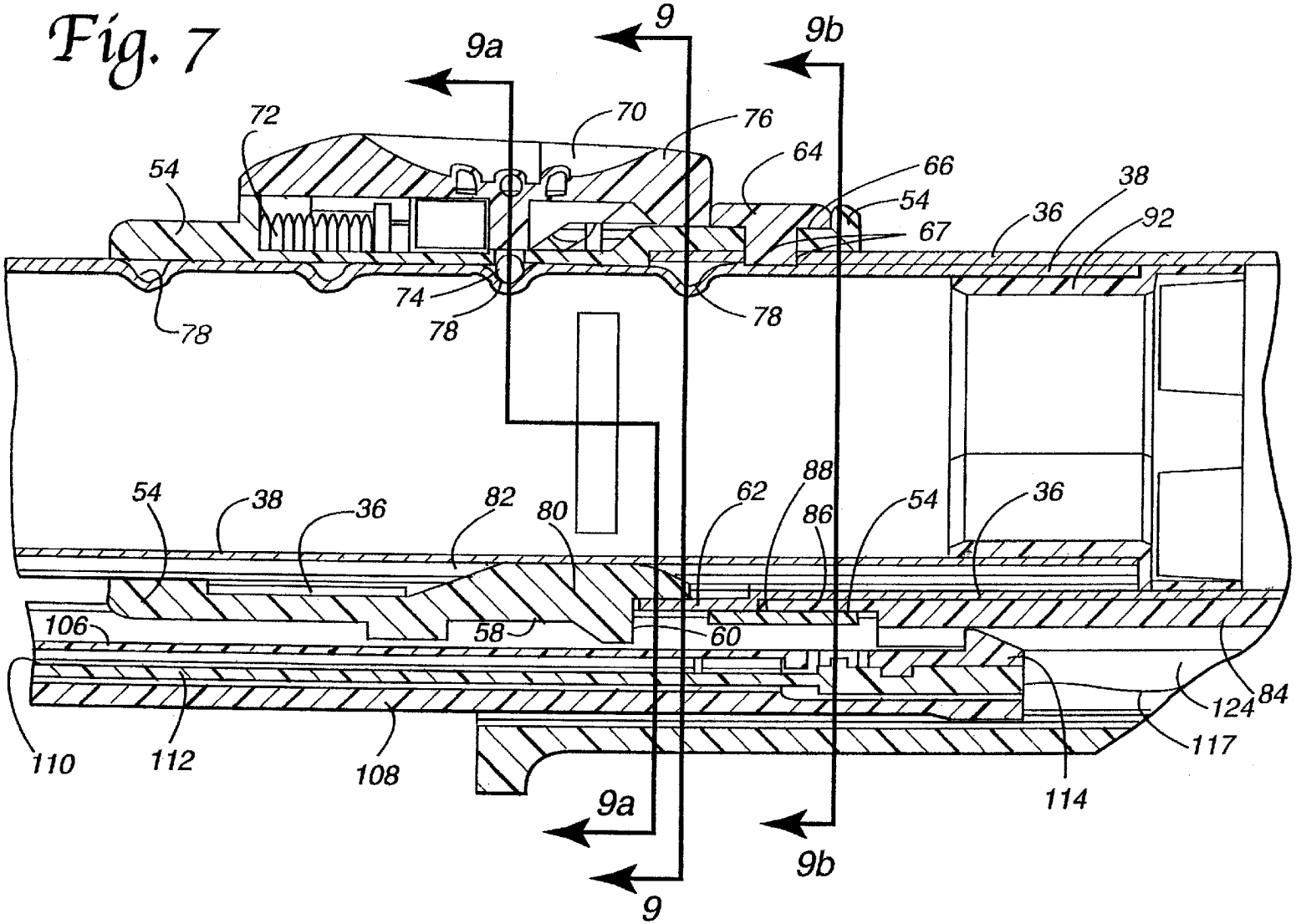
FIG. 7 is a cross-sectional view taken along line 7—7 of FIG. 3*a;*
Figure 9B:
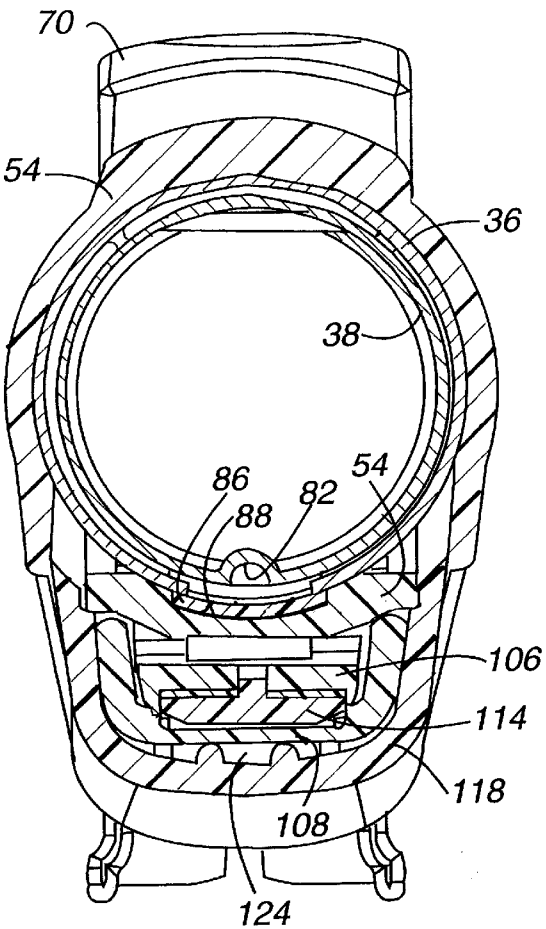
FIGS. 9, 9*a* and 9*b* are transverse cross-sectional views taken along lines 9—9, 9*a*–9*a* and 9*b*–9*b,* respectively, of FIG. 7.
Figure 9A:
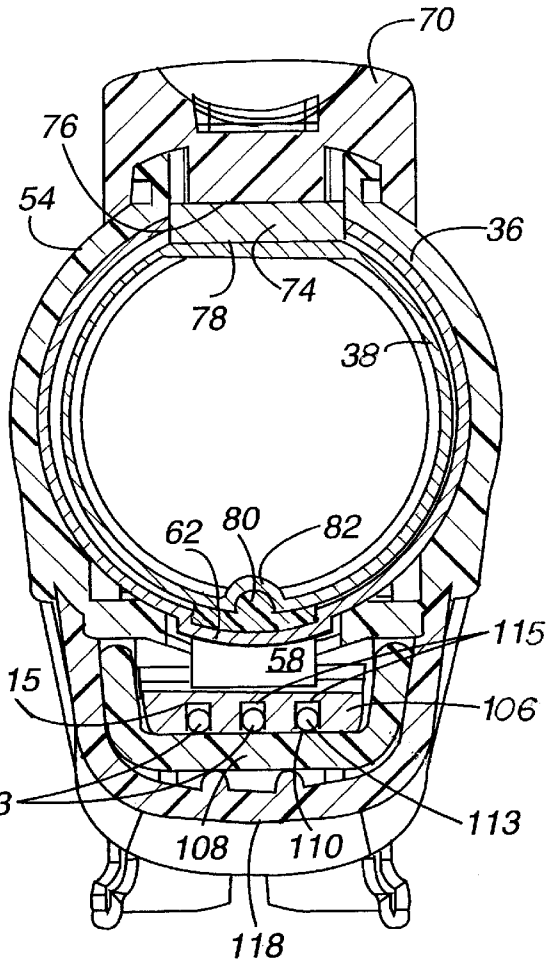
Figure 9:
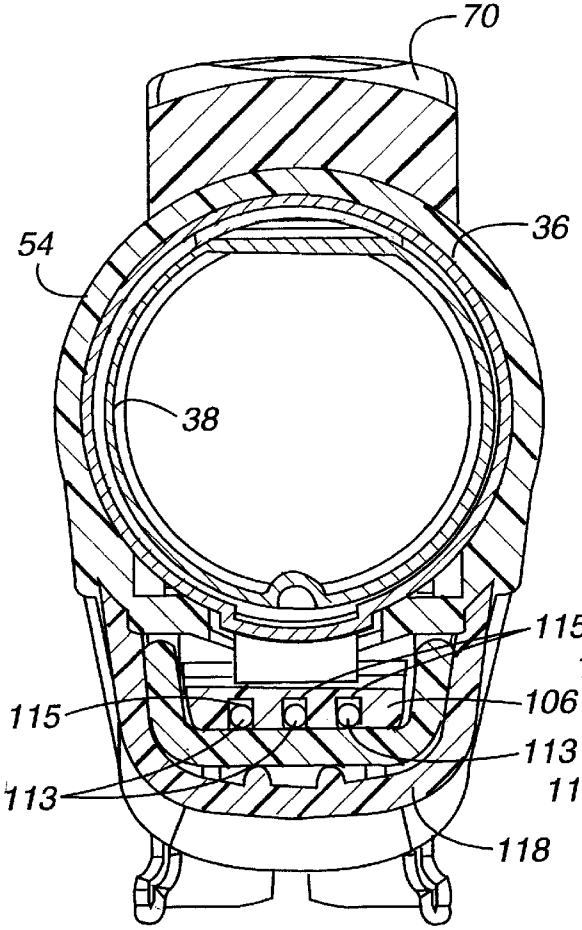

As best shown in FIGS. 7 and 9*a,* the wand coupling 54 also carries an actuator 70 that is biased by a spring 72 to engage a locking pin 74 through the integral cam 76. As shown, the locking pin 74 is selectively received in any one of a series of locking notches 78 longitudinally spaced along the second tube 38. In order to adjust the length of the telescoping wand, one manipulates the actuator 70 against the force of the spring 72 thereby drawing the cam 76 away from the locking pin 74. This frees the locking pin 74 so that it may move freely up the sloped wall of the locking notch 78 in which it was previously engaged. As the position of the second tube 38 relative to the first tube is further adjusted, the locking pin 74 continues to glide freely along the second tube. Once the actuator 70 is released, the spring 72 again biases the actuator so that the cam 76 engages the locking pin 74 pushing the pin downward into the next locking notch 78 which it meets. The locking pin 74 is then held in that cooperating locking notch 78 to lock the respective positions of the first and second tubes 36, 38 of the telescoping wand in the new, desired position.

Registration of the locking notches 78 with the locking pin 74 is insured by the provision of a guide pin 80 on the projecting lug 58 of the wand coupling 54 and a cooperating registration groove 82 running longitudinally along the second telescoping tube 38. Specifically, as best shown in FIGS. 7 and 9*a,* the guide pin 80 rides in the registration groove 82 and thereby prevents rotations of the second tube 38 relative to the first tube 36.

A sheath 84 may be integrally formed with, heat fused or otherwise secured to the first portion 44 of the hose coupling 40. The sheath 84, hose coupling 40 and wand coupling 54 are all formed from an electrical insulating plastic material. As shown, the sheath 84 extends substantially the full length from the first portion 44 of the hose coupling 40 to the wand coupling 54 (see FIGS. 4, 5 and 10). A tongue 86 on the sheath 84 is received in a cooperating groove 88 formed in the wand coupling 54 in order to provide a secure connection (see also FIGS. 7 and 9*b*). As should be appreciated, the face 90 of the sheath 84 is arcuate and shaped to substantially receive and mate with the first tube 36.

Figure 10:
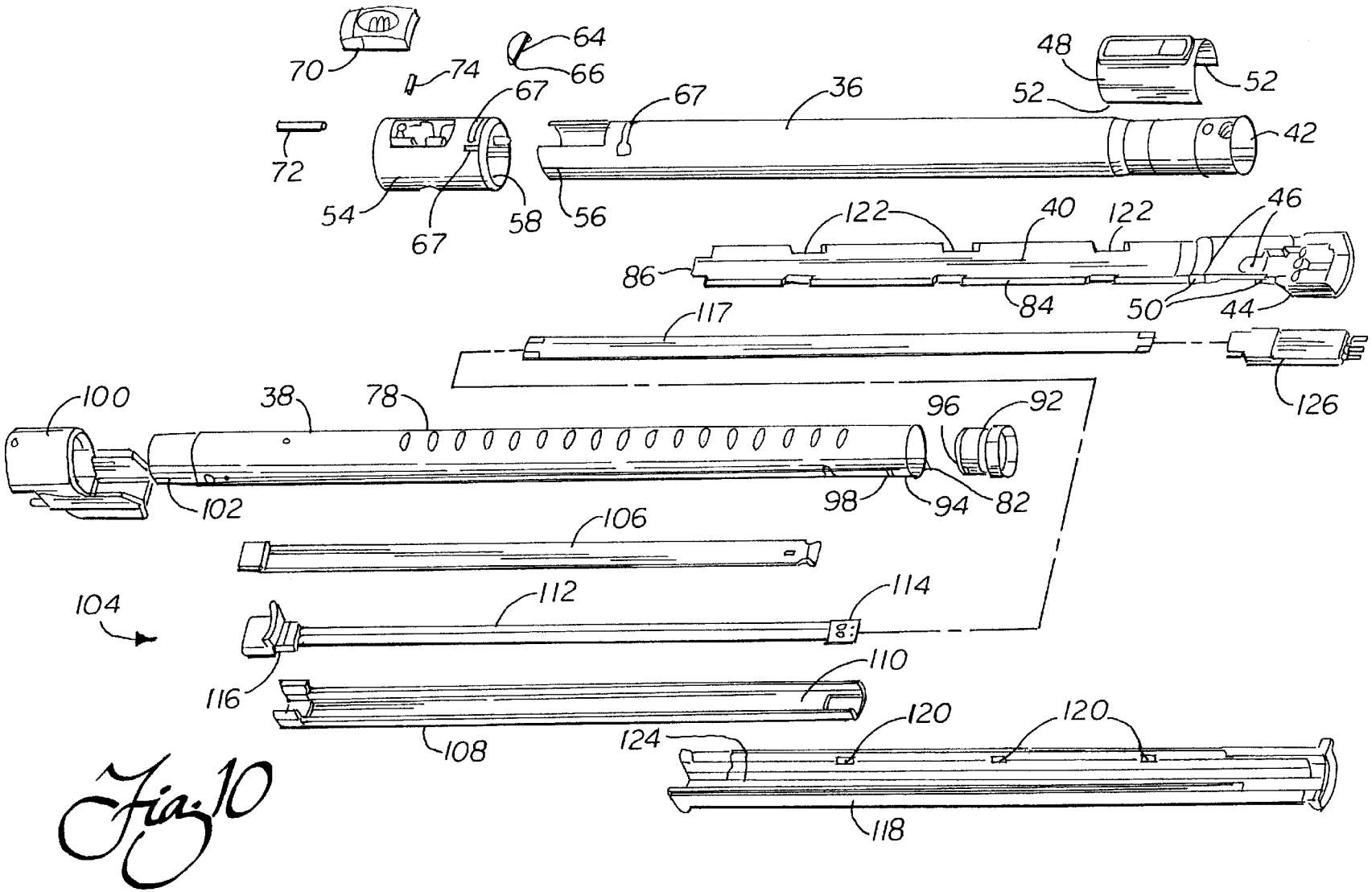
FIG. 10 is an exploded perspective view of the wand assembly.

An anchor sleeve 92 is secured to a first terminus 94 of the second tube 38 (see FIGS. 5 and 10). One or more resilient tabs 96 each engage a cooperating opening 98 to secure the anchor sleeve 92 in position.

Figure 6:
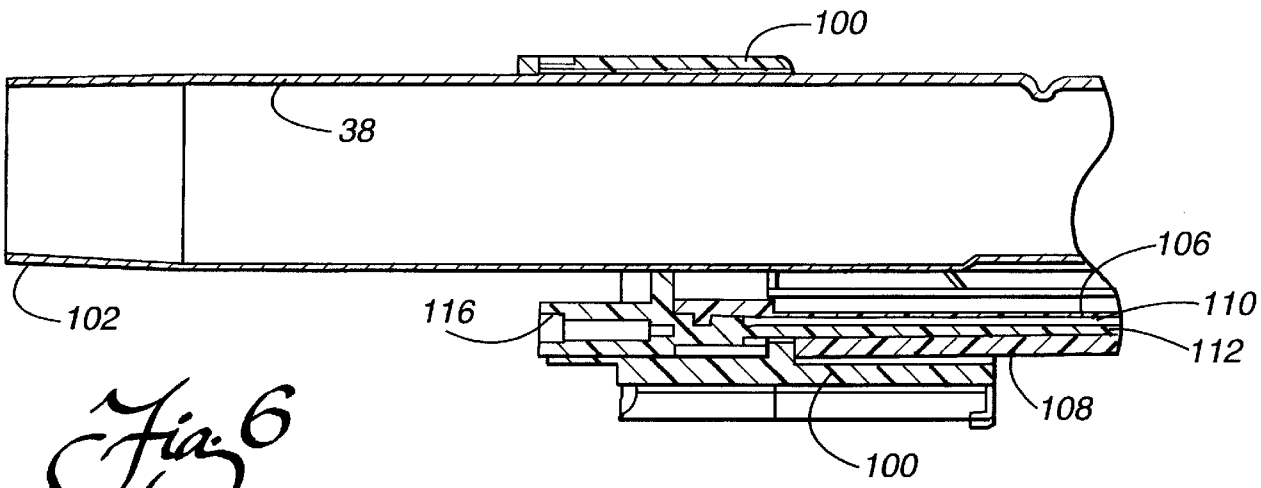
FIG. 6 is a cross-sectional view taken along line 6—6 of FIG. 3*a;*

A nozzle coupling 100 is secured to the second terminus 102 of the second tube 38 (see FIGS. 6 and 10). Nozzle coupling 100 may be secured in position by friction fit or mechanical means such as rivets or resilient tabs (not shown). Nozzle coupling 100 allows connection of the second terminus 102 of the second tube 38 to the nozzle 24.

Cooperating first and second strip members 106, 108 are joined together by cooperating flanges and grooves or other means to form the first, inner subassembly or conductor casing of the telescoping insulator assembly 104. As best shown in FIG. 10, strip member 108 includes a channel 110 which receives a three wire electrical conductor 112 bearing a first terminal 114 and a second terminal 116. The first terminal 114 is received and captured in the channel 124 defined by the sheath 84 and the outer housing 118 which together cooperate to form the second or outer subassembly of the telescoping insulator assembly 104 (see also FIGS. 7 and 9*b*). The second terminal 116 is mechanically secured by any means known in the art to the nozzle coupling 100 (see also FIG. 4). The electrical conductor 112 may be, for example, a three wire tape and must be of a sufficient length to span between the terminals 114, 116.

As best shown in FIGS. 4, 5 and 10, the electric conductor 112 extends through the channel 110 in the strip member 108. The open side of the channel 110 is closed by the strip member 106 which secures mechanically to the strip member 108 by resilient tabs or other known means. The conductor casing formed by the strip members 106, 108 of the insulator assembly 104 is secured adjacent the second tube 38 by mechanical connection to the nozzle coupling 100. There is no direct connection of the conductor casing to the second tube 38. Thus, there is no riveting or other connecting structure to interrupt the flow path of the lumen through the majority of the length of the second tube. Accordingly, cleaning efficiency is significantly enhanced.

When the wand assembly 34 is fully assembled, it should be appreciated that the second tube 38 freely telescopes with respect to the first tube 36 when the locking pin 74 is released from the locking notches 78 by operation of the actuator 70. Accordingly, a slight clearance is provided between both the outer diameter of the anchor sleeve 92 and second tube 38 and the inner diameter of the first tube 36.

Figure 3A:
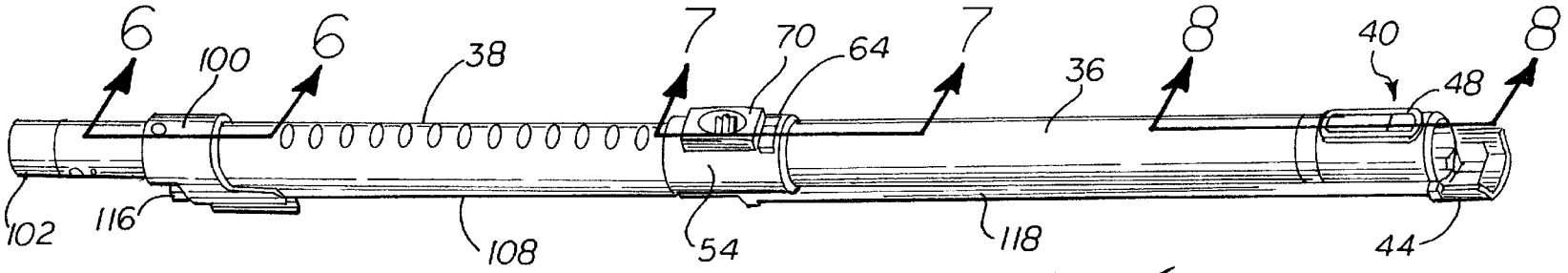
FIG. 3*a* is a perspective view of the wand assembly in the fully extended position.

Electrical conductor 112 also includes an extension in the form of a three wire ribbon cable 117 of sufficient length to span between the first terminal 114 and the fuse module 126 carried on the hose coupling 40 when the tubes 36, 38 are in the fully extended position (note FIGS. 3*a,* 3*b,* 6, 7 and 8). Preferably a first section of the ribbon cable 117 (approximately ½ the overall length of the ribbon cable) is attached to the sheath 84 by tape or adhesive while the remaining portion is captured freely in the channel 124 defined by the sheath and the outer housing 118. In the retracted position shown in FIGS. 2*a,* 2*b,* 4 and 5 the ribbon cable 117 folds back on itself in the channel 124. In the extended position shown in FIGS. 3*a,* 3*b,* 6, 7 and 8 the ribbon cable 117 extends straight out so as to maintain the electrical connection between the hose coupling 40 (and more specifically the module 126 described below) and the first terminal 114.

Figure 2B:
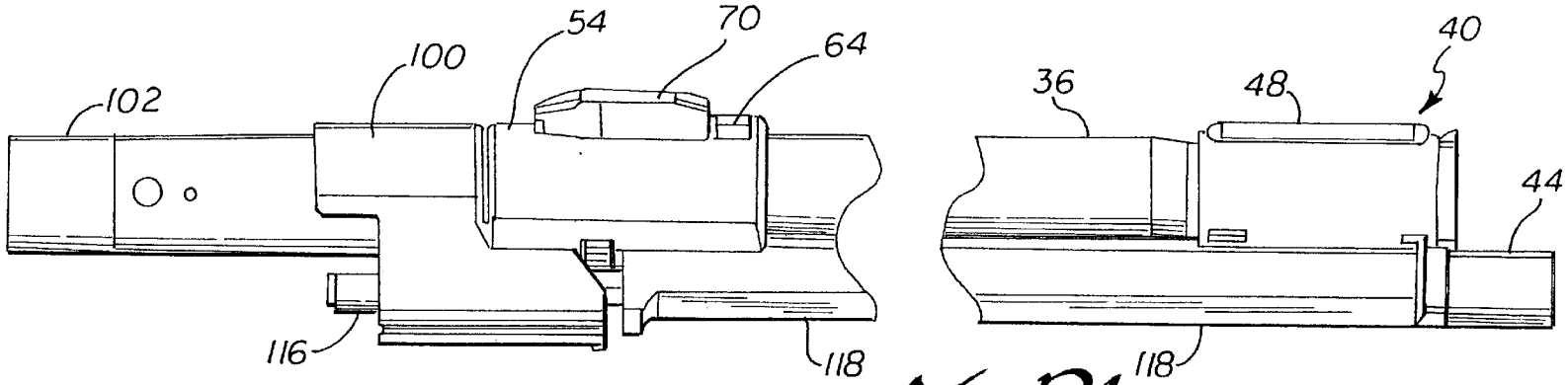
FIG. 2*b* is a side-elevational view of the wand assembly in the fully retracted position.
Figure 3B:
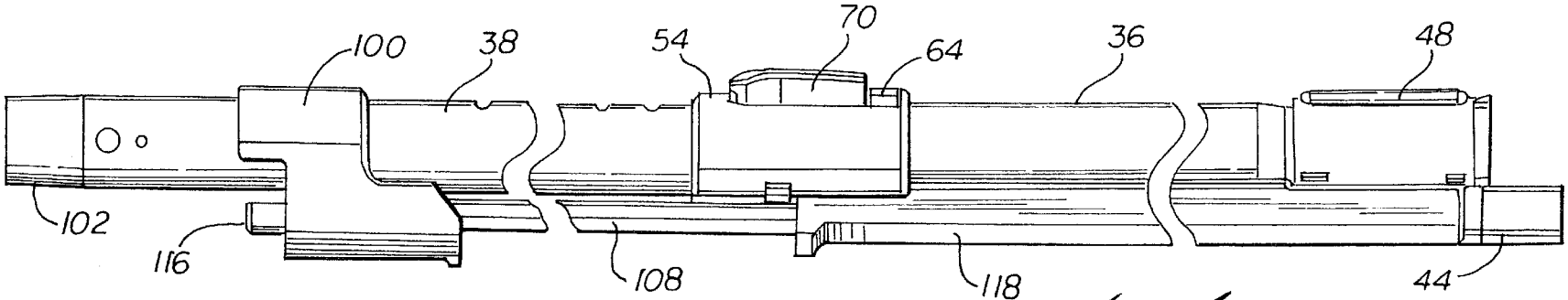
FIG. 3*b* is a side-elevational view of the wand assembly in the fully extended position.

The electrical conductor 112 including the ribbon cable 117 is electrically insulated from the first and second tubes, 36, 38 by the telescoping insulator assembly 104 over its entire length in any relative telescoping position of the tubes. Thus, as best shown in FIG. 10 and briefly described above, the outer housing 118 is also provided. Outer housing 118 is secured to the first portion 44 of the hose coupling 40 and the sheath 84 by means of cooperating tabs 120 and notches 122 which provide tight engagement and rigidity to increase the strength of the assembly (see FIGS. 5, 8, 9*b* and 10). Together, the sheath 84 and outer housing 118 of the second insulator assembly define the channel 124 which is dimensioned and adapted to receive the conductor casing formed by the strip members 106, 108 and the electric conductor 112 contained therein (note each of the three wires 113 of conductor 112 received in the spaced channels 115 formed in strip member 106 in FIGS. 9 and 9*a*), as well as the ribbon cable 117 when the wand is in the fully retracted position shown in FIGS. 2*a* and 2*b*. When in the fully extended position shown in FIGS. 3*a* and 3*b,* it should be appreciated that the ribbon cable 117 and terminal 114 of the electrical conductor 112 are fully enclosed within the channel 124 by the sheath 84 and the outer housing 118 while electrical conductor 112 is fully enclosed within the channel 110 formed by the strip members 106 and 108 of the conductor casing. Thus, the channel 124 and the channel 110 form the first and second portions of a channel system which holds the electrical conductor 112 in a position where that conductor is fully electrically insulated and physically isolated from the first and second telescoping tubes 36, 38.

Figure 11:
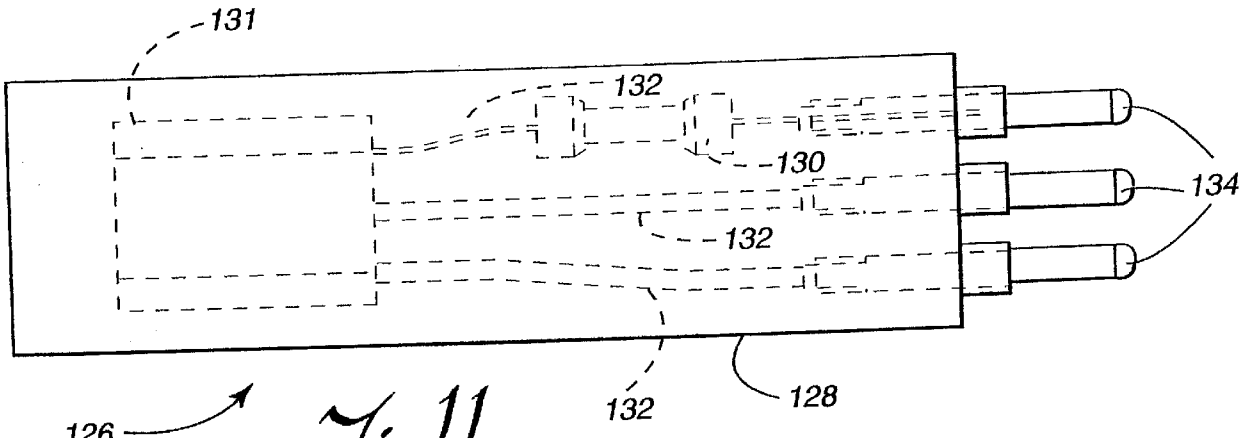
FIG. 11 is a rear elevational view showing the fuse module.
Figure 12:
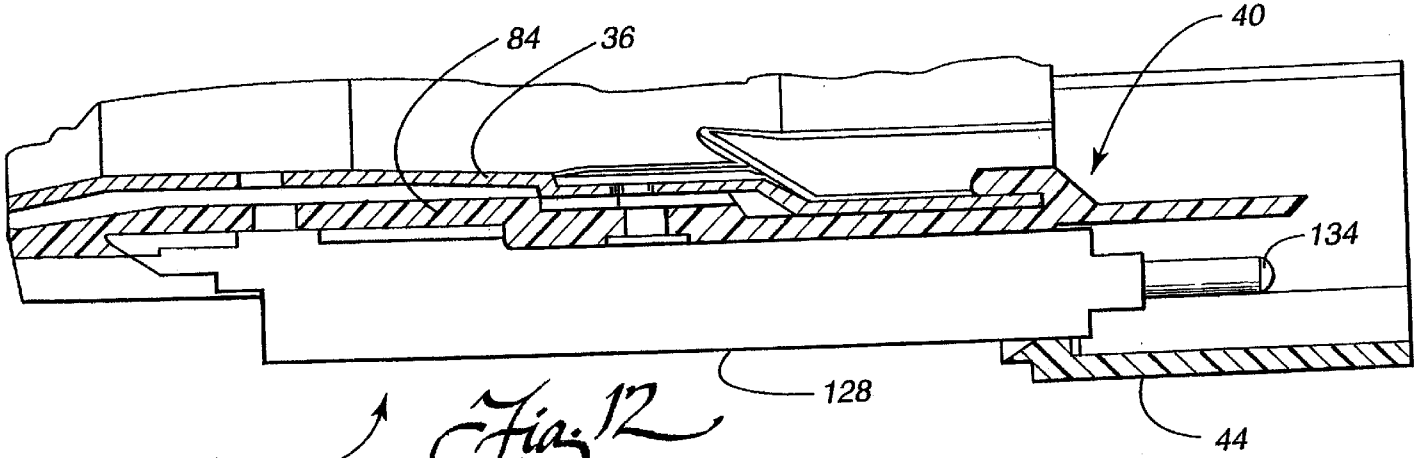
FIG. 12 is a partially cross-sectional and schematic detailed view showing the mounting of the fuse module on the hose coupling.

In accordance with still another aspect of the present invention, a fuse module 126 is provided. The fuse module 126 may be releasably mechanically secured by any appropriate means known in the art to the hose coupling 40. Fuse module 126 comprises a housing 128 which carries a fuse 130, a plug 131, a series of electrical conductors 132 and a series of connection terminals 134 (see FIG. 11). The plug 131 engages with the ribbon cable 117. The connection terminals 134 engage with a cooperating electrical plug (not shown) carried on the hose 11. The fuse 130 protects the agitator drive motor in the event of a power surge or electrical overload. In the event that it becomes necessary to replace the fuse 130, the entire fuse module 126 is removed and replaced. As the fuse module 126 is easily accessible and conveniently snaps in and out of the hose coupling 40, this design represents a significant convenience feature of the present invention (see also FIG. 12).

Both the terminal 116 and the module 126 are formed from an electrical insulating material such as polyvinylchloride or ABS plastic characterized by a minimum electrical resistance of substantially $50\times10^6$ ohm-centimeters. Accordingly, any static charge that might otherwise build up in the metal tubes 36, 38 due to the frictional action of dirt and debris engaging the wall as it travels through the lumen is dissipated. The electrical pathway between the outer tube 36 and the module 126 is completed by the rivets 46. The electrical pathway between the terminal 116 and the inner tube 38 is by direct contact.

In summary, numerous benefits results from employing the concepts of the present invention. A telescoping wand having first and second tubes 36, 38 of metal construction is provided. Such a wand advantageously allows the provision of a lumen/air pathway of increased cross-sectional area for increased air flow and movement of entrained dirt and debris while also allowing the overall outer diameter of the wand assembly to be reduced so that the wand is easier to grasp and manipulate.

The telescoping insulator assembly 104 includes parts 106, 108, 84 and 118 that function together to electrically insulate the electrical conductor 112 from the first and second tubes 36, 38 along the entire length thereof in any telescoping position. The sheath 84 and outer housing 118 are secured to the hose coupling 40 and wand coupling 54 rather than the outer tube 36. Similarly, the strip members 106, 108 of the conductor casing are secured at one end to the nozzle coupling 100 rather than the inner or second tube 38 and captured at the other end in the channel 124 defined between the sheath 84 and outer housing 118. Accordingly, the tubes 36, 38 have smooth, uninterrupted lumen walls throughout most of their length for more efficient movement of air. In addition, a convenient fuse module 126 is readily accessed by the user in the event a fuse change becomes necessary.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed is:

1. An electric vacuum cleaner, comprising:

a canister housing including an internal chamber and a suction inlet and an exhaust outlet both communicating with said chamber;

a suction generator held in said internal chamber;

a dust collector held in said internal chamber between said suction inlet and said suction generator;

a nozzle for picking up dirt and debris, said nozzle including an inlet and an outlet;

a hose communicating with said suction inlet;

a motor driven agitator and drive motor carried on said nozzle; and a wand assembly providing fluid communication between said outlet of said nozzle and said hose, said wand assembly including respective first and second telescoping tubes, an electrical conductor carrying electricity toward said nozzle from said hose and canister housing to power said drive motor; and said wand assembly being characterized by forming said first and second telescoping tubes from metal and providing an insulator assembly including an enclosed channel which receives and holds said electrical conductor in substantially any respective position of said first and second telescoping tubes so that said electrical conductor is electrically insulated from said first and second telescoping tubes.

2. The vacuum cleaner set forth in claim 1, wherein said metal is aluminum.

3. The vacuum cleaner set forth in claim 1, wherein said metal is steel.

4. The vacuum cleaner set forth in claim 1, further including a hose coupling secured to a first end of said first telescoping tube, a wand coupling secured to a second end of said first telescoping tube, an anchor sleeve secured to a first terminus of said second telescoping tube and a nozzle coupling secured to a second terminus of said second telescoping tube.

5. The vacuum cleaner set forth in claim 4, wherein said wand coupling is secured to said first telescoping tube, said wand coupling including an actuator and a locking pin and said second telescoping tube including a series of locking notches which receives said locking pin so as to secure and lock said first and second telescoping tubes in a selected telescoping position.

6. The vacuum cleaner set forth in claim 5, further including a spring which biases said actuator and said locking pin into a locked position.

7. The vacuum cleaner set forth in claim 5, further including a guide pin carried on said wand coupling and a registration groove extending longitudinally along said second telescoping tube, said guide pin engaging in said registration groove to prevent relative rotation between said first and second telescoping tubes.

8. The vacuum cleaner set forth in claim 5, further including a snap clip and snap clip receiving apertures in said wand coupling and said first telescoping tube, said snap clip engaging in said snap clip receiving apertures to secure said wand coupling and said first telescoping tube together.

9. The wand assembly set forth in claim 1, further including an electrical pathway for grounding said first and second telescoping tubes and preventing build-up of static electrical charge.

10. A wand assembly for a vacuum cleaner including a nozzle, a hose and a canister housing, said wand assembly comprising: first and second telescoping tubes defining an air path for fluid communication between the nozzle and the hose and an electrical conductor carrying electricity toward said nozzle from said hose and canister housing;

said wand assembly being characterized by forming said first and second telescoping tubes from metal and providing an insulator assembly including an enclosed channel which receives and holds said electrical conductor in substantially any respective position of said first and second telescoping tubes so that said electrical conductor is electrically insulated from said first and second telescoping tubes.

11. The vacuum cleaner set forth in claim 1 or 10, wherein said insulator assembly is telescoping.

12. The wand assembly set forth in claim 10, wherein said metal is aluminum.

13. The wand assembly set forth in claim 10, wherein said metal is steel.

14. The wand assembly set forth in claim 10, further including a hose coupling secured to a first end of said first telescoping tube, a wand coupling secured to a second end of said first telescoping tube, an anchor sleeve secured to a first terminus of said second telescoping tube and a nozzle coupling secured to a second terminus of said second telescoping tube.

15. The wand assembly set forth in claim 14, wherein said wand coupling is secured to said first telescoping tube, said wand coupling including an actuator and a locking pin and said second telescoping tube including a series of locking notches which receives said locking pin so as to secure and lock said first and second telescoping tubes in a selected telescoping position.

16. The wand assembly set forth in claim 15, further including a spring which biases said actuator and said locking pin into a locked position.

17. The wand assembly set forth in claim 15, further including a guide pin carried on said wand coupling and a registration groove extending longitudinally along said second telescoping tube, said guide pin engaging in said registration groove to prevent relative rotation between said first and second telescoping tubes.

18. The wand assembly set forth in claim 15, further including snap clip receiving apertures in said wand coupling and said first telescoping tube and a snap clip, said snap clip engaging in said snap clip receiving apertures to secure said wand coupling and said first telescoping tube together.

19. A wand assembly for a vacuum cleaner including, a nozzle and a base comprising:

first and second telescoping tubes defining an air path for fluid communication between the nozzle and the hose;

an electrical conductor running along said tubes; and a telescoping insulator assembly which receives, physically isolates and electrically insulates said electrical conductor from said first and second telescoping tubes.

20. The wand assembly set forth in claim 19, wherein said telescoping insulator assembly includes a first electrical insulator assembly mounted to said second telescoping tube and a second electrical insulator assembly mounted to said first telescoping tube, said second electrical insulator assembly freely slidingly receiving said first electrical insulator assembly.

21. A method of constructing a vacuum cleaner comprising: providing a canister housing holding a suction generator and a dust collector, a nozzle carrying a motor driven agitator and drive motor, and a hose and a telescoping wand assembly connecting the nozzle with the canister housing;

powering said drive motor through an electrical conductor carried by said wand assembly; and electrically insulating said electrical conductor from said wand assembly by physically isolating said electrical conductor in a telescoping insulator assembly.

22. An electric vacuum cleaner, comprising:

a canister housing including an internal chamber and a suction inlet and an exhaust outlet both communicating with said chamber;

a suction generator held in said internal chamber;

a dust collector held in said internal chamber between said suction inlet and said suction generator;

a nozzle for picking up dirt and debris, said nozzle including an inlet and an outlet;

a hose communicating with said suction inlet;

a motor driven agitator and drive motor carried on said nozzle; and a wand assembly providing fluid communication between said outlet of said nozzle and said hose, said wand assembly including respective first and second telescoping tubes, an electrical conductor carrying electricity toward said nozzle from said hose and canister housing to power said drive motor; and said wand assembly being characterized by forming said first and second telescoping tubes from metal and providing an insulator assembly including an enclosed channel which receives and holds said electrical conductor in substantially any respective position of said first and second telescoping tubes so that said electrical conductor is electrically insulated from said first and second telescoping tubes;

said vacuum cleaner further including a hose coupling secured to a first end of said first telescoping tube, a wand coupling secured to a second end of said first telescoping tube, an anchor sleeve secured to a first terminus of said second telescoping tube and a nozzle coupling secured to a second terminus of said second telescoping tube wherein said insulator assembly includes an electrically insulating sheath defining a wall of a first portion of said channel and extending along a substantially full length of said first telescoping tube between said hose coupling and said wand coupling.

23. The vacuum cleaner set forth in claim 22, wherein said insulator assembly includes an electrically insulating conductor casing extending along a substantially full length of said second telescoping tube between said nozzle coupling and said anchor sleeve for telescoping movement into and out of said first portion of said channel.

24. The vacuum cleaner set forth in claim 23, wherein said conductor casing includes first and second strip members that are connected together to define a second portion of said channel which receives at least a portion of said electrical conductor.

25. The vacuum cleaner set forth in claim 23, wherein said electrical conductor includes a first terminal, a second terminal and a ribbon cable extension.

26. The vacuum cleaner set forth in claim 25, further including a removable fuse module that is secured to said hose coupling and engages said ribbon cable extension.

27. The vacuum cleaner set forth in claims 23, 24, 25 or 26 wherein said insulator assembly includes an outer housing that engages said sheath so as to define said first portion of said channel which telescopingly receives said conductor casing and said electrical conductor when said telescoping wand is in a fully retracted position.

28. The vacuum cleaner set forth in claim 27, wherein said outer housing and said sheath do not penetrate said first telescoping tube or said second telescoping tube but said sheath engages an outer wall of said first tube for increased rigidity.

29. The vacuum cleaner set forth in claim 27, wherein said sheath and outer housing include cooperating interlocking tabs and notches.

30. A wand assembly for a vacuum cleaner including a nozzle, a hose and a canister housing, said wand assembly comprising: first and second telescoping tubes and an electrical conductor carrying electricity toward said nozzle from said hose and canister housing;

said wand assembly being characterized by forming said first and second telescoping tubes from metal and providing an insulator assembly including an enclosed channel which receives and holds said electrical conductor in substantially any respective position of said first and second telescoping tubes so that said electrical conductor is electrically insulated from said first and second telescoping tubes;

said wand assembly further including a hose coupling secured to a first end of said first telescoping tube, a wand coupling secured to a second end of said first telescoping tube, an anchor sleeve secured to a first terminus of said second telescoping tube and a nozzle coupling secured to a second terminus of said second telescoping tube wherein said insulator assembly further includes an electrically insulating sheath defining a wall of a first portion of said channel and extending along a substantially full length of said first telescoping tube between said hose coupling and said wand coupling.

31. The wand assembly set forth in claim 30, wherein said insulator assembly includes an electrically insulating conductor casing extending along a substantially full length of said second telescoping tube between said nozzle coupling and said anchor sleeve for telescoping movement into and out of said first portion of said channel.

32. The wand assembly set forth in claim 31, wherein said conductor casing includes first and second strip members that are connected together to define a second portion of said channel which receives at least a portion of said electrical conductor.

33. The wand assembly set forth in claim 31, wherein said electrical conductor includes a first terminal, a second terminal and a ribbon cable extension.

34. The wand assembly set forth in claim 33 further including a removable fuse module that is secured to said hose coupling and engages said ribbon cable extension.

35. The wand assembly set forth in claims 31, 32, 33 or 34 wherein said insulator assembly includes an outer housing that engages said sheath so as to define said first portion of said channel which telescopingly receives said conductor casing and said electrical conductor when said telescoping wand is in a fully retracted position.

36. The wand assembly set forth in claim 35, wherein said outer housing and said sheath do not penetrate said first telescoping tube or said second telescoping tube but said sheath engages an outer wall of said first tube for increased rigidity.

37. The wand assembly set forth in claim 35, wherein said sheath and outer housing include cooperating interlocking tabs and notches.

* * * * *

UNITED STATES PATENT AND TRADEMARK OFFICE

CERTIFICATE OF CORRECTION

PATENT NO : 6,148,474

DATED : November 21, 2000

INVENTOR(S) : Naoyuki Ohara, William R. Tracy

It is certified that error appears in the above-identified patent and that said Letters Patent are hereby corrected as shown below:

Column 10, Line 30 in Claim 19, delete ","
Column 10, Line 31 in Claim 19, replace "base" with "hose".

Signed and Sealed this

Eighth Day of May, 2001

*Attest:*

Nicholas P. Godici

NICHOLAS P. GODICI

*Attesting Officer*

*Acting Director of the United States Patent and Trademark Office*